United States Patent [19]

Macrow

[11] 4,255,176

[45] Mar. 10, 1981

[54] COMBINED AIR PURIFIER AND DESTRATIFIER

[76] Inventor: Lawrence Macrow, 2330 W. Blood, East Aurora, N.Y. 14052

[21] Appl. No.: 67,607

[22] Filed: Aug. 20, 1979

[51] Int. Cl.[3] ..... B01D 50/00; F24F 3/16; F24F 13/00

[52] U.S. Cl. ..... 55/415; 55/126; 55/385 A; 55/419; 55/468; 98/33 A; 98/38 D

[58] Field of Search ..... 55/126, 267, 338, 385 A, 55/415, 419, 467, 468; 98/33 A, 38 D

[56] References Cited

U.S. PATENT DOCUMENTS

| | | | |
|---|---|---|---|
| 2,234,633 | 3/1941 | Hoppe | 98/33 A |
| 2,262,542 | 11/1941 | Bahnson, Jr. | 55/419 |
| 2,417,408 | 3/1947 | Ford | 98/33 A |
| 2,765,726 | 10/1956 | Powers | 98/38 E |
| 3,538,657 | 11/1970 | Macrow | 55/231 |
| 3,626,669 | 12/1971 | Cardiff | 55/126 |
| 4,152,973 | 5/1979 | Peterson | 98/33 A |
| 4,164,901 | 8/1979 | Everett | 55/126 |

*Primary Examiner*—David L. Lacey
*Attorney, Agent, or Firm*—Joseph P. Gastel

[57] ABSTRACT

A combined unit for purifying and destratifying heated air including a first inlet at a lower area for receiving air to be purified, an air purifier including an air demister and an electrostatic precipitator, a fan for drawing air through the first inlet and moving the air through the air purifier, a second air inlet in a higher area for receiving heated air to be destratified, nozzles for receiving purified air under pressure from the air purifier, venturis associated with the nozzles for creating a suction as purified air leaves the nozzles for causing stratified heated air to be drawn into the second inlet, air outlets for discharging a mixture of purified and destratified heated air, a plate with an opening between the air purifier and the second inlet; and a damper for selectively uncovering the opening for permitting purified air to be discharged through the second inlet.

3 Claims, 6 Drawing Figures

COMBINED AIR PURIFIER AND DESTRATIFIER

BACKGROUND OF THE INVENTION

The present invention relates to a combined air purifier and destratifier for performing the combined function of purifying air in areas such as machine shops and other types of factories and also destratifying heated air for comfort heating purposes.

By way of background, air purifiers utilized in factories and machines shops are well known. Certain of these air purifiers are of the type shown in U.S. Pat. No. 3,538,657 which remove oil and other foreign particles from the air. In addition, this type of air purifier and demister has been used in combination with an electrostatic precipitator to remove smaller particles which are not removed by the demister. Air purifiers of the foregoing type, which are also known as mist collectors, are usually placed above the machinery in a machine shop where they cleanse the air from oil and other foreign matter. However, air purifiers of the foregoing type have negligible effect on the stratified heated air at the upper portions of the shop.

By way of further background, the heat generated by machining metal in a machine shop usually rises to the top of the shop from which it is lost through the roof. Attempts have been made in the past to utilize this stratified heated air for its heating potential. In this respect, circulating fans have been mounted on the ceiling in an attempt to cause the heated upper layers of air to mix with the lower layers. This was highly inefficient for a number of reasons, namely, because it created strong drafts and further because the turbulence from the fans caused undesirable circulation of foreign matter in the air. It is with the treatment of the problems of air purification and stratification of heated air in an expedient manner that the present invention is concerned.

SUMMARY OF THE INVENTION

It is one object of the present invention to provide a combined air purifier and destratifier which not only purifies air in an area such as a machine shop or the like by removing both liquid and solid particulate matter, but also destratifies the heated upper layers of air and utilizes the heat therein for heating purposes. A related object of the present invention is to provide a combined air purifier and destratifier which produces improved air purification because it recirculates upper layers of air which contain undesirable particulate matter to the air purifier.

Another object of the present invention is to provide an improved air purifier and destratifier which is capable of conserving energy both in hot weather and in cold weather by discharging heated air to the upper strata of a room during hot weather, or by recirculating heated upper strata of air during cold weather. Other objects and attendant advantages of the present invention will readily be perceived hereafter.

The present invention relates to a combined unit for purifying and destratifying air comprising a first air inlet in a first area for receiving air to be purified, air purifying means for receiving air from said first inlet and removing foreign matter from said air, a second air inlet in a second area for receiving air to be destratified, air moving means for drawing air through said first and second inlets and through said air purifying means, and air outlet means for discharging air received by said unit from said first and second inlets. The combined unit also includes damper means for selectively permitting the purified air to be discharged from the second inlet into the upper strata so that such air, which is heated, does not provide heating to the lower air strata during warm weather. The various aspects of the present invention will be more fully understood when the following portions of the specification are read in conjunction with the accompanying drawings wherein:

DESCRIPTION OF THE PREFERRED EMBODIMENTS

Figure 1:
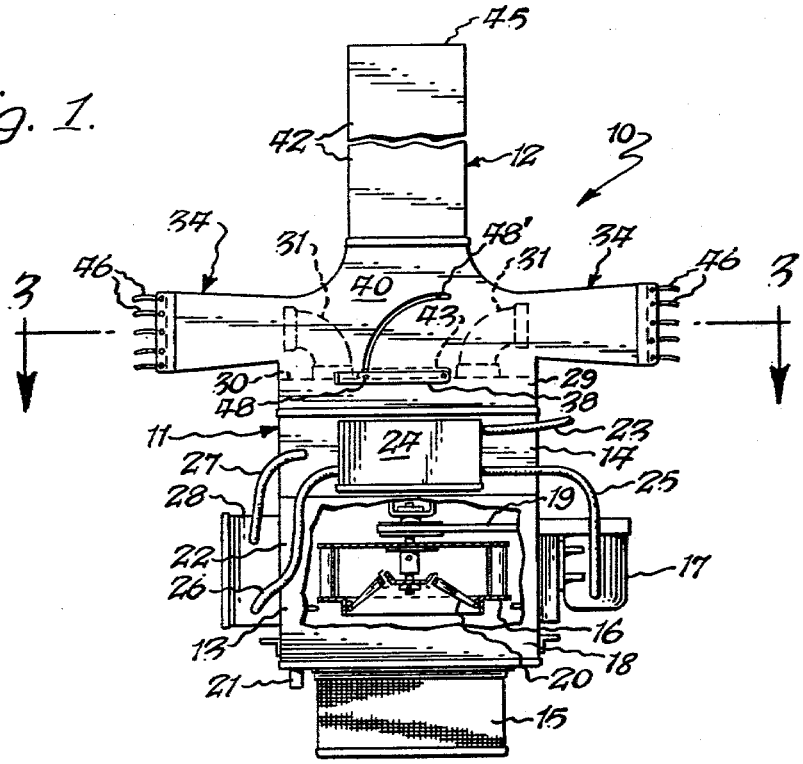
FIG. 1 is a fragmentary side elevational view of the combined air purifier and destratifier of the present invention with the housing of the air purifier being broken away to show the fan and demister wheel enclosed therein.

The combined air purifier and destratifier 10 of the present invention includes an air purifier portion 11 and a destratifier portion 12. The air purifier portion 11 in turn consists of an air demisting portion 13 and an electrostatic precipitator 14 mounted thereon. Air to be purified is drawn into housing 18 through screened air inlet portion 15 by centrifugal fan 16 which is driven by motor 17 through belt 19. A mist collector wheel or element 20 is mounted within fan 16 and collects oil and other foreign particulate matter from the air which is drawn into inlet 15, and deposits such oil in a trough, not shown, which is connected to liquid outlet 21. The air demister-fan combination 16 and 20 may be identical in structure to that disclosed in FIG. 24 of U.S. Pat. No. 3,538,657, except that motor 17 is mounted externally of housing 22 and except that the scroll has been omitted. This portion of U.S. Pat. No. 3,538,657 is therefore incorporated here by reference. By way of brief description, however, air demister element 20 is a frustoconical member having an outer surface formed of threads extending longitudinally along and defining the outer surface of the frustoconical member.

A large portion of liquid and solid particulate matter in the incoming air is removed by element 20. Fan 16 thereafter forces the remaining air through electrostatic precipitator 14 which may be of any suitable construction. The electrostatic precipitator attracts small particles which have been charged so that these particles are removed from the air stream, as is well known. The foregoing structure by itself, including the demister 13 and the electrostatic precipitator 14, are old and are not, per se, part of the present invention, except for the fact that they are utilized individually and/or in combination with destratifier 12, as more fully described hereafter.

The power for motor 17 and precipitator 14 is obtained from electrical inlet conduit 23 which leads from a suitable power source to main starter box 24. An electrical lead 25 extends between main starter box 24 and electric motor 17. Another electrical lead 26 extends from main starter box 24 to electronic charging apparatus contained in box 28. Lead 27 leads from box 28 to electrostatic precipitator 14 which includes the various wires and plates which charge and attract the particles to be removed from the air stream, as is well known.

Figure 3:
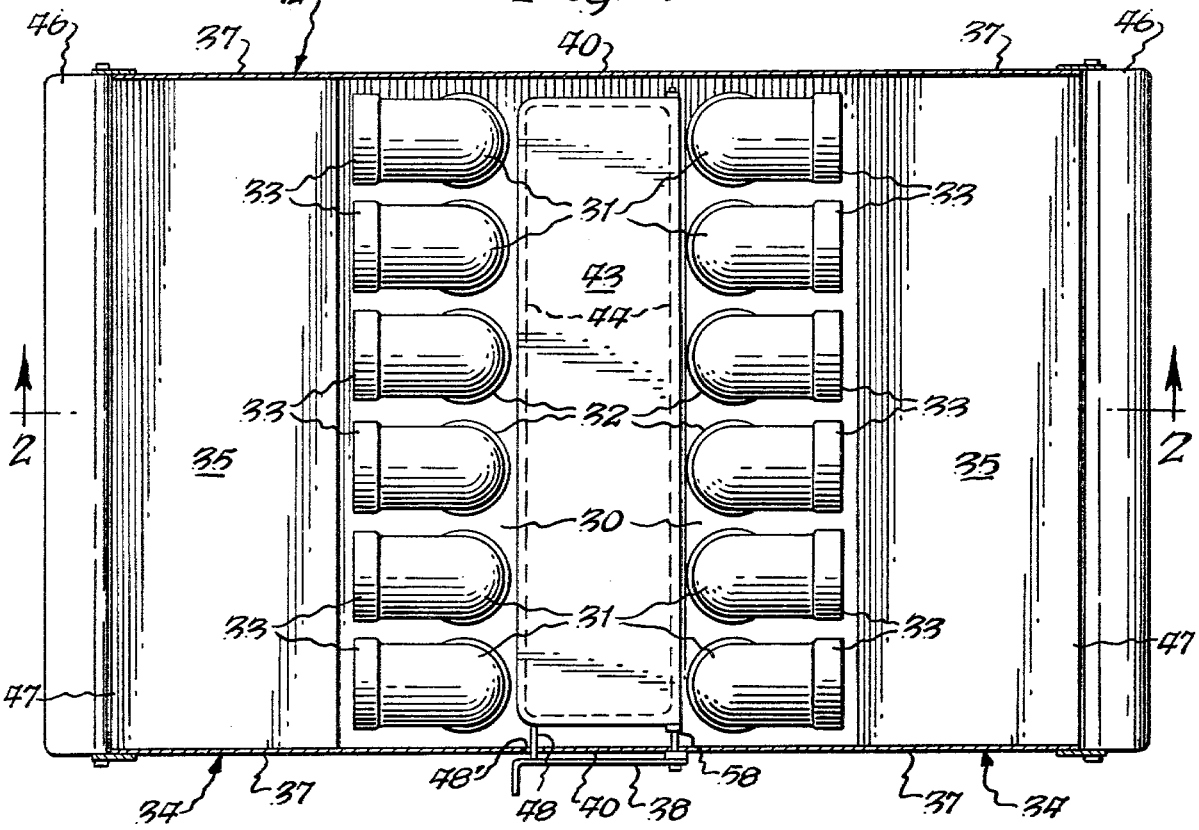
FIG. 3 is a cross sectional view taken substantially along line 3—3 of FIG. 1.

The purified air leaving precipitator 14 enters plenum chamber 29 which is located above precipitator 14. A plate 30 defines the upper boundary of plenum chamber 29. A plurality of nozzles 31 have their inlet ends 32 mounted on plate 30 to receive air from plenum chamber 29. The outlet ends 33 of nozzles 31 are located in venturi sections 34. These venturi sections are essentially rectangular in cross section and include lower planar walls 35, upper substantially planar walls 36, and planar end walls 37. A curved wall portion 39 extends from each of planar wall portions 36 and in combination with the central portions 40 which join walls 37 (FIGS. 1 and 3) forms a rectangular opening 41 which receives duct 42 of destratifier 12. A damper 43 is mounted on plate 30 for the purpose of selectively opening rectangular aperture 44 in plate 30. A handle 38 is attached to damper 43 for swinging it between open and closed positions, with pin 48 extending through slot 48' and attaching handle 38 to damper 43.

When damper 43 is closed, as shown, the air being discharged from nozzles 31, entrains air from duct 42 and thus causes air to be drawn into inlet portion 45 of duct 42. Duct 42 may be of any suitable length so that inlet 45 is near the ceiling of the building where warm air accumulates. Thus, this warm air is drawn into duct 42 and is mixed with the purified air being discharged from nozzles 31 in venturis 34. A plurality of hinged louvers 46 are pivotally mounted at the outlet ends 47 of the venturis to direct the mixed air in any desired direction, either downwardly, straight outwardly, or upwardly.

It is to be especially noted that the apparatus so far described is intended especially for use in machine shop operations, where the air is laden with oil from machining operations and is to be purified by purifier 11. In machine shops there is considerable heat generated as a result of the machining operations, and this heat heats the air, which in turn rises to the ceiling where it forms a relatively high temperature layer of air which is several degrees higher than the air that is near the floor. The heat from the air at the ceiling is lost to the outside at a greater rate than cooler air in an amount which is directly proportional to the temperature difference between the temperature of this air and the outside air. Because of the loss of heat from this higher temperature air to the outside, it frequently develops that even though the air at the ceiling is warmer than is required for workmen's comfort, the floor air is cold due to infiltration of cold air into the lower levels of the room. This, in the past, has made it necessary to add heat at the lower level of the shop to produce worker comfort, even while heat is being lost at an excessive rate from the upper levels of the shop because of the above-described stratification. Thus, the heat generated by the machines is largely wasted.

By way of quantitative analysis and strictly by way of hypothetical example, in a typical machine shop of 14,000 square feet located in a northern location where the winter design temperature is 0° F., the total heat loss might amount to 641,000 Btu/hr. However, this same shop may have as much as 1,000 horsepower in machinery which generates heat at the rate of 2,545,000 Btu/hr., if all machines are operating at full load. Assuming that only 50% of this amount is available for various reasons, the heat liberated from machining is still 1,272,500 Btu/hr., and this is practically double the total heat loss of 641,000 Btu/hr.

By drawing stratified warm air near the ceiling into duct inlet 45, this air is mixed with the purified air emanating from the nozzles 33 and discharged to lower levels of the shop, depending on the positioning of louvers 46. Thus, the heat generated from machining operations can essentially be utilized to provide a very substantial part of the heat which is required for heating a machine shop.

In addition to the foregoing heat conservation factor, it is to be noted that the air which is drawn into duct inlet 45 is returned to the lower room levels where it is again drawn into inlet 15 of the air purifier. Thus, warm foreign particles which would normally be at the upper levels of stratification and gradually settle are drawn in to the air purifier and removed from the room air. Therefore, the destratifier not only provides heat to the room, when operated as described above, but also causes foreign particles to be moved from the higher strata to the lower portions of the room where they can be passed through the air purifier, to thereby produce more effective air purification.

Figure 2:
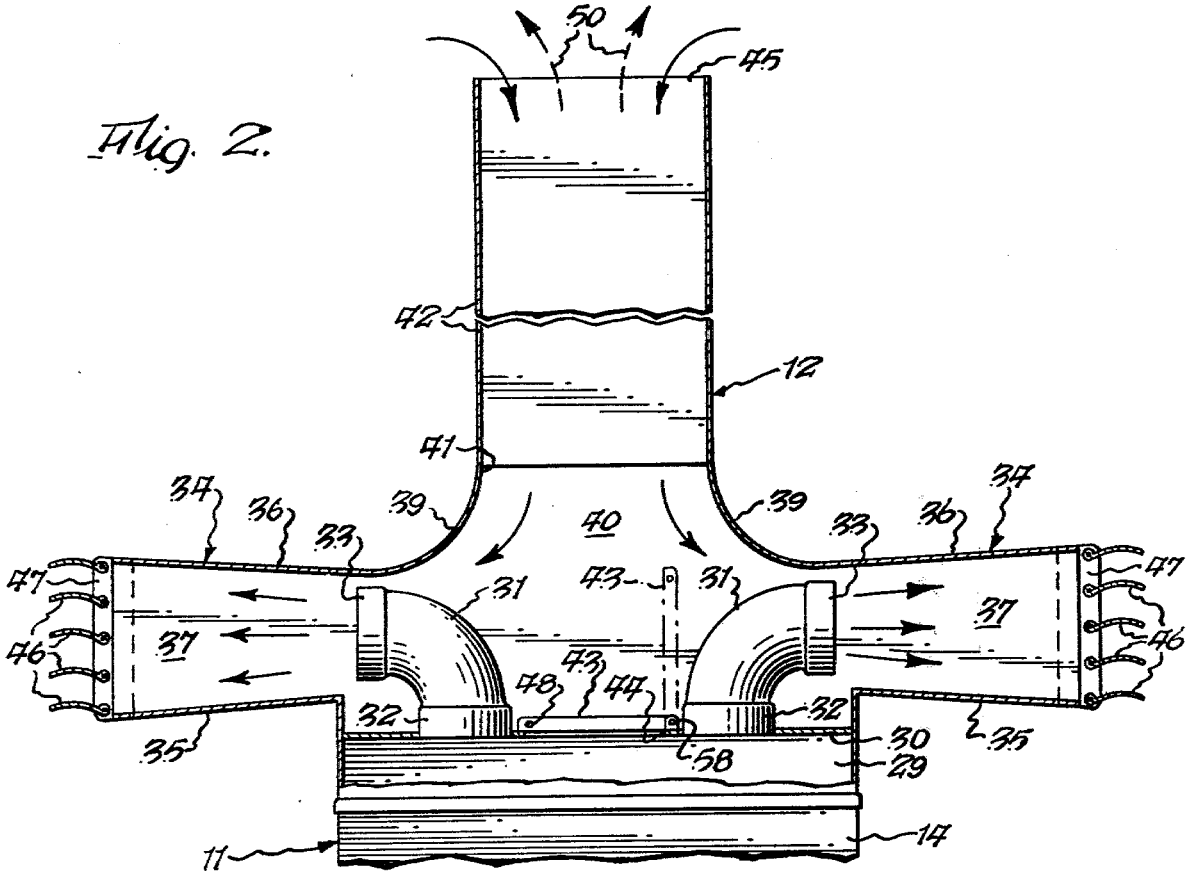
FIG. 2 is a fragmentary cross sectional view taken substantially along line 2—2 of FIG. 3 and showing the discharge nozzles for purified air, the venturi structure, the damper structure, and the destratifier duct.

The foregoing description has dealt with the matter of destratifying the warm air near the top of the room, so as to utilize its heating potential. However, during summer time, it is desirable to exhaust the air from the upper strata of the machine shop so that artificial cooling is not needed for worker comfort. Accordingly, when this type of operation is desired, damper 43 is opened by pivoting it by means of handle 38 about hinge 58 to the dotted line position shown in FIG. 2. In this condition, the air from plenum 29 will be discharged through opening 44 directly into duct 42 and it will follow the path of the dotted arrows 50, so that it is discharged from upper duct portion 45, which now functions as an outlet. At this time, if desired, the upper end 45 of duct 42 may be vented out of the building by suitable ductwork (not shown) so that the hot air is discharged. When the hot air is discharged, the fan 16 will induce cooler air through the building windows and normal leakage areas so as to provide a measure of induced cooling. Under certain circumstances it may not be necessary to utilize ductwork in conjunction with outlet 45 to discharge air to the outside, if, for example, there are exhaust fans in the ceiling. In fact even if there is no way of disposing of the heated air, it is better to conduct it to the upper strata of the room rather than to discharge it through venturi-sections 34.

Figure 4:
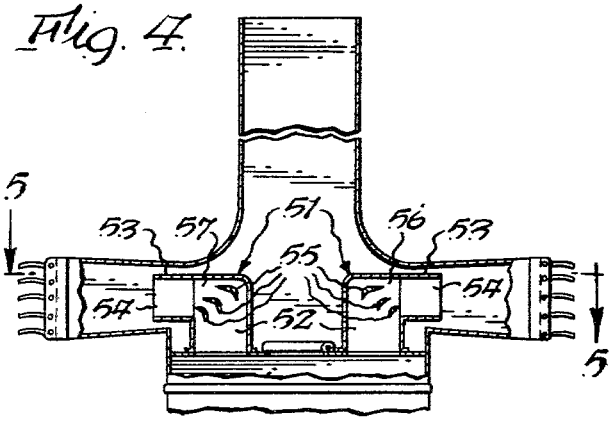
FIG. 4 is a fragmentary cross sectional view of a different type of nozzle construction.
Figure 5:
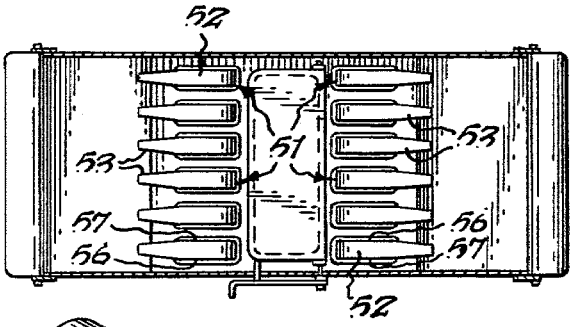
FIG. 5 is a view taken substantially along line 5—5 of FIG. 4.
Figure 6:
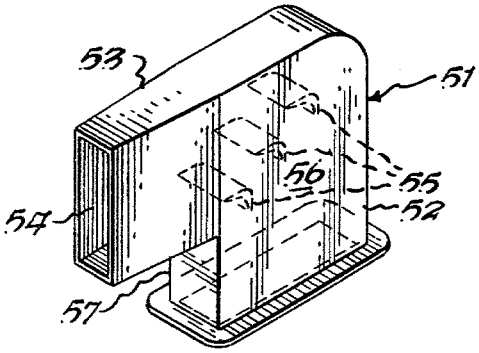
FIG. 6 is a perspective view of the nozzle structure of FIGS. 4 and 5.

In FIGS. 4–6 an alternate type of nozzle construction is shown for utilization with the venturis. The nozzle construction is the only difference between the embodiment of FIGS. 4–6 and the embodiment of FIGS. 1–3 described above. Each nozzle 51 includes a substantially rectangular housing portion 52 and an outlet portion 53 which converges to outlet 54. A plurality of vanes 55 have their opposite ends secured between walls 56 and 57 to direct air from plenum 29 through the nozzle outlets 54. Aside from the foregoing construction, the combined air purifier and destratifier of FIGS. 4–6 is identical to the embodiment of FIGS. 1–3.

While the foregoing description has shown an air purifier consisting of a rotatable demisting element or wheel 20 in combination with an electrostatic precipitator, it is to be understood that the purifier can be of any form or type whatsoever consistent with the present invention, and the air purifier portion may consist only of a demister or a precipitator.

While preferred embodiments of the present invention have been disclosed, it will be understood that the present invention is not limited thereto but may be otherwise embodied within the scope of the following claims.

What is claimed is:

1. A combined unit for purifying and destratifying air comprising a first air inlet in a first area for receiving air to be purified, air purifying means for receiving air from said first inlet and removing foreign matter from said air, a second air inlet at a higher level than said first air inlet for receiving air to be destratified, fan means for moving air through said first air inlet and through said air purifying means, air outlet means including nozzle means for discharging said air received by said unit from said first inlet, venturi means for receiving air discharged from said nozzle means, and duct means for effecting communication between said second air inlet and said venturi means to thereby cause said air being discharged from said nozzle means to draw air through said duct means from said second inlet and cause said air from said second inlet to be discharged through said outlet means along with said air from said first inlet.

2. A combined unit for purifying and destratifying air as set forth in claim 1 including a plate having an opening therein located between said first and second inlets, and damper means on said plate to cause said air received from said first inlet to be selectively discharged from said air outlet means when said damper means closes said opening and for causing said air received from said first inlet to be discharged from said second inlet when said damper means does not close said opening.

3. A combined unit for purifying and destratifying air comprising a first air inlet in a first area for receiving air to be purified, air purifying means for receiving air from said first air inlet and removing foreign matter from said air, a second air inlet at a higher level than said first air inlet for receiving air to be destratified, air outlet means for discharging air from said unit, means for moving air from said first air inlet and said purifying means to be discharged from said air outlet means, means for moving air from said second air inlet to be discharged from said air outlet means, a plate separating said first and second air inlets, an opening in said plate, duct means for effecting communication between said first and second air inlets and damper means on said plate to cause air received from said first and second air inlets to be selectively discharged from said air outlet means when said damper means closes said opening and for causing said air received from said first inlet to be passed through said duct means to discharged from said second air inlet when said damper means does not close said opening.

* * * * *